United States Patent [19]

van Esdonk et al.

[11] 3,942,061

[45] Mar. 2, 1976

[54] GAS DISCHARGE PANEL

[75] Inventors: Johannes van Esdonk; Johannes Petrus Hornman, both of Eindhoven, Netherlands

[73] Assignee: U.S. Philips Corporation, New York, N.Y.

[22] Filed: Nov. 22, 1974

[21] Appl. No.: 526,135

[30] Foreign Application Priority Data

Dec. 20, 1973 Netherlands ..... 7317435

[52] U.S. Cl. ..... 313/188; 313/220

[51] Int. Cl.[2] ..... H01J 61/00

[58] Field of Search ..... 313/188, 220

[56] References Cited

UNITED STATES PATENTS 3,634,720 1/1972 Kupsky ..... 313/220

*Primary Examiner*—R. V. Rolinec
*Assistant Examiner*—Darwin R. Hostetter
*Attorney, Agent, or Firm*—Frank R. Trifari; Carl P. Steinhauser

[57] ABSTRACT

A gas discharge panel in which the cathodes are placed in grooves and are connected to the bottom of the groove throughout their length by means of low softening-point glass enamel. The glass is preferrably devitrified (crystalline).

3 Claims, 3 Drawing Figures

GAS DISCHARGE PANEL

The invention relates to a gas discharge panel consisting at least of an insulating base plate and a transparent insulating top plate, which plates each have a set of parallel conductors which are insulated from each other and which cross each other at an angle and between which at the crossings cavities are present in which the gas discharge can occur.

The invention relates in particular to a panel in which at least the electrodes destined to be cathodes are secured to the insulating plate at approximately 440°C by means of a low melting type of glass such as the glaze commercially available as "Pyroceram".

A gas discharge panel is described in U.S. Pat. No. 3,837,958 in which the cathodes are secured to an insulating plate throughout their length by means of non-crystallizing glass enamel. The occurrence of discharges between the facing sides of the cathodes is avoided by using a readily meltable type of glass which forms a meniscus against the sides of the conductors. Therefore, it must be possible for this type of glass to become liquid.

A drawback is that the temperature at which such types of glass are sufficiently liquid to form a meniscus against the sides of the conductors is comparatively high, namely approximately 570°C, so that the possibility exists that the conductors oxidize too considerably. This could be avoided by placing the panel during melting the glaze in a nitrogen atmosphere, as described in the U.S. Pat. 3,634,720, but such a method is complicated. Low-melting-point glazes, such as "Pyroceram", remain too thickly liquid to be able to form a meniscus. At least the electrodes which are destined to be cathodes are arranged in grooves and are secured to the insulating plate with glaze throughout their length, according to the invention, in a panel. As a result of this the occurrence of mutual discharges between the cathodes is avoided, while nevertheless the low melting "Pyroceram" may be used as a glaze since it is not necessary now to form a meniscus.

It is necessary to secure the cathodes in grooves throughout their length. If, as is stated for the anodes in the said U.S. Pat. Specification 3,634,720, the cathodes would be secured in the grooves with glaze only at their ends, the discharge tends to creep between the conductor and the bottom of the groove so that the cleaning of the cathode surface during the testing period occurs irregularly and a large spreading in the operating and ignition voltage of the gas discharges occurs.

The invention will be described in greater detail with reference to the accompanying drawing, of which:

FIG. 1 is a sectional view through a panel according to the invention, while

Figure 1:
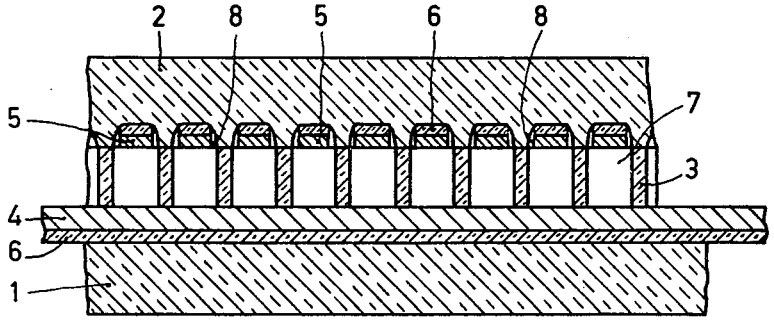

Reference numeral 1 in the drawing denotes an insulating base plate which consists of glass or a ceramic material or of an electrically oxidized aluminum plate. Like the plate 1, the top plate 2 which consists of a transparent material has grooves 8 in which conductors 4 and 5, respectively, are secured by means of a readily melting type of glass 6, such as the glass available commercially as "Pyroceram". This type of glass softens sufficiently already at 440°C to adhere to the conductors 4 and 5 and to the bottom of the groove. Since said type of glass does not become thinly liquid, gaps remain on the sides of the conductors 4 (FIG. 2), as a result of which the cavities 7 of the intermediate plate 3 which is placed between the base plate 1 and the top plate 2, communicate with each other so that the cavities can be evacuated and filled with the desired gas.

Figure 2:
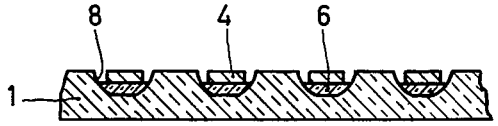
FIG. 2 is a sectional view through an insulating plate with cathodes according to the invention.
Figure 3:
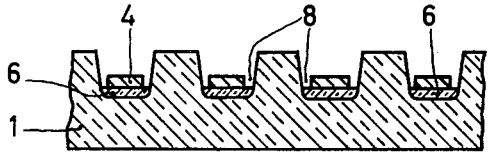
FIG. 3 shows another embodiment thereof.

In order to enable exchange of the anodes and cathodes, both the conductors 4 and the conductors 5 are preferably secured to the bottom of the groove throughout their length by means of a layer of glaze 6. However, this is necessary only for the conductors 4 destined to be cathodes. The conductors 5 destined to be anodes might be connected in the grooves only at their ends, if desired, as is shown in FIG. 2 of the above-mentioned U.S. Pat. Specification No. 3,634,720.

If the grooves are deeper than is shown in the drawing, so that the surface of the conductors 4 and/or 5 lies below the surface of the insulating plate 1 and/or 2, the perforated intermediate plate 3 may be omitted which means a great simplification in the manufacture. This embodiment is particularly suitable for systems having two sets of electrodes. The cavities are then formed by the grooves 8 themselves.

Since according to the invention the low melting glass "Pyroceram" can be used without the drawback of discharge between the sides of the cathodes 4 occurring, or the discharge occurs on the lower side of the cathodes, it is not necessary to perform the heating for melting the "Pyroceram" in a neutral gas atmosphere since, due to the comparatively low temperature, only a slight oxidation of the electrodes occurs which consist, for example, of chromium-nickel-iron having 5% by weight of chromium and equal quantities by weight of nickel and iron, which oxide layer is removed in a short time from the upper surface of the electrodes during the testing period. This is also due to the fact that the discharge can no longer take place between the electrodes and the bottom of the groove.

Although only a few embodiments are shown, panels may also have other constructions without departing from the scope of this invention. For example, it is possible to provide more than two sets of electrodes in the tubes or to divide the cathode into groups and to interconnect the cathodes of each group.

What is claimed is:

1. A gas discharge panel comprising an insulating base plate and a transparent insulating top plate, a set of parallel conductors which are insulated from each other in each plate and which cross each other at an angle, said conductors being spaced at the crossings to define cavities which are filled with an ionizable gas in which a gas discharge can occur, the electrodes of one of said sets constituting cathodes being positioned in grooves and are secured to the insulating plate throughout their length by means of a low softening-point glass enamel.

2. A gas discharge panel as claimed in claim 1, the sides of the conductors and the sidewalls of the grooves are separated by a gap.

3. A gas discharge panel as claimed in claim 1 in which the glass enamel is devitrified.

* * * * *